US010789882B2

(12) United States Patent
Tang et al.

(10) Patent No.: US 10,789,882 B2
(45) Date of Patent: Sep. 29, 2020

(54) OPTICAL COMPENSATION APPARATUS APPLIED TO PANEL AND OPERATING METHOD THEREOF

(71) Applicant: Raydium Semiconductor Corporation, Hsinchu (TW)

(72) Inventors: Shang-Ping Tang, Zhubei (TW); Hung Li, Taipei (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 196 days.

(21) Appl. No.: 16/009,258

(22) Filed: Jun. 15, 2018

(65) Prior Publication Data

US 2018/0366056 A1 Dec. 20, 2018

Related U.S. Application Data

(60) Provisional application No. 62/521,560, filed on Jun. 19, 2017.

(51) Int. Cl.
*G09G 3/3208* (2016.01)

(52) U.S. Cl.
CPC ... *G09G 3/3208* (2013.01); *G09G 2320/0233* (2013.01); *G09G 2320/0295* (2013.01); *G09G 2320/0693* (2013.01); *G09G 2360/147* (2013.01)

(58) Field of Classification Search
CPC ..... G09G 3/3208; G09G 2320/0233; G09G 2320/0295; G09G 2320/0693; G09G 2360/14; G09G 2360/147
See application file for complete search history.

(56) References Cited

U.S. PATENT DOCUMENTS

2007/0091041 A1* 4/2007 Chung ..... G09G 3/006 345/88
2007/0126975 A1* 6/2007 Choi ..... G09G 3/006 349/192
2011/0157242 A1* 6/2011 Wang ..... G09G 3/3426 345/690
2011/0227964 A1* 9/2011 Chaji ..... G09G 3/006 345/690
2014/0043318 A1* 2/2014 Choo ..... G09G 3/3225 345/214

(Continued)

*Primary Examiner* — Amare Mengistu
*Assistant Examiner* — Crystal Mathews

(57) ABSTRACT

An optical compensation apparatus applied to panels is disclosed. A panel of the panels includes sub-pixels. The optical compensation apparatus includes an optical measurement module, a data processing module and an optical compensation module. The optical measurement module measures optical measurement values corresponding to the sub-pixels. The data processing module determines first optical compensation values needed for the sub-pixels according to the optical measurement values, determines an overall compensation operation reference of the panel accordingly, determines a demura algorithm suitable for the panel according to at least one threshold compensation value and the overall compensation operation reference and obtains second optical compensation values accordingly. Then, the optical compensation module outputs the second optical compensation values to perform optical compensation on a display data provided to the panel.

9 Claims, 4 Drawing Sheets

(56) References Cited

U.S. PATENT DOCUMENTS

| | | | | |
|---|---|---|---|---|
| 2015/0348456 | A1* | 12/2015 | Kao | G09G 3/2007 345/690 |
| 2016/0104411 | A1* | 4/2016 | Nathan | G09G 3/2007 345/690 |
| 2016/0343304 | A1* | 11/2016 | Hwang | G09G 3/3258 |
| 2017/0206821 | A1* | 7/2017 | Lee | G09G 3/20 |
| 2017/0243562 | A1* | 8/2017 | Hu | G09G 3/2092 |
| 2018/0033395 | A1* | 2/2018 | Masuyama | G09G 5/02 |
| 2018/0040295 | A1* | 2/2018 | Deng | G09G 3/2007 |
| 2018/0047368 | A1* | 2/2018 | Luo | G09G 3/20 |
| 2018/0075802 | A1* | 3/2018 | Liu | G09G 3/20 |
| 2018/0102088 | A1* | 4/2018 | Deng | G09G 3/3208 |
| 2018/0102091 | A1* | 4/2018 | Deng | G09G 3/006 |
| 2018/0190214 | A1* | 7/2018 | Kim | G09G 3/006 |
| 2018/0218693 | A1* | 8/2018 | Zhang | G09G 3/3685 |
| 2018/0357944 | A1* | 12/2018 | Tang | G09G 3/3208 |
| 2018/0357945 | A1* | 12/2018 | Tang | G09G 3/2003 |

* cited by examiner

OPTICAL COMPENSATION APPARATUS APPLIED TO PANEL AND OPERATING METHOD THEREOF

BACKGROUND OF THE INVENTION

1. Field of the Invention

The invention relates to a panel; in particular, to an optical compensation apparatus applied to the panel and an operating method thereof.

2. Description of the Prior Art

Current organic light-emitting diode (OLED) panels often suffer from mura and affect their yield. The so-called "mura" refers to various traces caused by non-uniform brightness of the panel. Since the mura generally exists on the background of non-uniform light source, it is impossible for the human eye to effectively distinguish between normal image and mura. As a result, many techniques for correcting mura have emerged.

A common demura method at present is to firstly measure the brightness of each sub-pixel of the panel to determine whether each sub-pixel has mura, and then to change the data signal outputted to each sub-pixel of the panel accordingly and then achieve the effect of lightness compensation.

However, the severity of mura may be different in different panels. As shown in FIG. 1, the severities of a first mura MR1 and a second mura MR2 displayed on a first panel PL1 and a second panel PL2 respectively are very different. At this time, if the same demura algorithm is used to perform optical compensation on the first panel PL1 and the second panel PL2, it is likely to cause over-compensation or under-compensation and it needs to be overcome.

SUMMARY OF THE INVENTION

Therefore, the invention provides an optical compensation apparatus applied to a plurality of panels and an operating method thereof to solve the above-mentioned problems of the prior arts.

A preferred embodiment of the invention is an optical compensation apparatus. In this embodiment, the optical compensation apparatus is applied to a plurality of panels. A first panel of the plurality of panels includes a plurality of sub-pixels for displaying a display data. The optical compensation apparatus includes an optical measurement module, a data processing module and an optical compensation module. The optical measurement module is used for measuring a plurality of first optical measurement values corresponding to the plurality of sub-pixels of the first panel. The data processing module is coupled to the optical measurement module and used for determining a plurality of first optical compensation values needed for the plurality of sub-pixels according to the first optical measurement values respectively, determining a first overall compensation operation reference of the first panel according to the plurality of first optical compensation values, determining a first demura algorithm suitable for the first panel according to at least one adjustable threshold compensation value and the first overall compensation operation reference and obtaining a plurality of second optical compensation values according to the first demura algorithm. The optical compensation module is coupled to the data processing module and used for outputting the plurality of second optical compensation values to perform optical compensation on the display data provided to the first panel.

In an embodiment, the plurality of panels is an organic light-emitting diode (OLED) panel.

In an embodiment, the plurality of optical measurement values is lightness values of the plurality of sub-pixels.

In an embodiment, the optical measurement module includes a control unit, an optical measuring unit and a data accessing unit. The control unit is used for providing a control signal. The optical measuring unit is coupled to the control unit and used for performing optical measuring on the plurality of sub-pixels of the first panel according to the control signal to obtain the plurality of first optical measurement values. The data accessing unit is coupled to the optical measuring unit and used for accessing the plurality of optical measurement values from the optical measuring unit.

In an embodiment, the data processing module includes a data analyzing unit, a data processing unit, an overall compensation operation reference generation unit and a demura algorithm selection unit. The data analyzing unit is coupled to the optical measurement module and used for receiving and analyzing the plurality of first optical measurement values. The data processing unit is coupled to the data analyzing unit and used for determining the first optical compensation values needed for the sub-pixels according to the first optical measurement values respectively. The overall compensation operation reference generation unit is coupled to the data processing unit and used for determining the first overall compensation operation reference of the first panel according to the plurality of first optical compensation values. The demura algorithm selection unit is coupled to the overall compensation operation reference generation unit and used for determining a first demura algorithm suitable for the first panel according to at least one adjustable threshold compensation value and the first overall compensation operation reference and obtaining the plurality of second optical compensation values according to the first demura algorithm.

In an embodiment, when the first overall compensation operation reference is smaller than or equal to a first threshold compensation value of the at least one threshold compensation value, the data processing module determines that the first demura algorithm corresponding to the first threshold compensation value is suitable for the first panel.

In an embodiment, when the first overall compensation operation reference is smaller than or equal to a first threshold compensation value of the at least one threshold compensation value, the data processing module determines that the first demura algorism corresponding to the first threshold compensation value is suitable for the first panel.

In an embodiment, the optical compensation module and the first panel are both coupled to a display driving apparatus, and the display driving apparatus receives the display data and the plurality of second optical compensation values respectively and performs optical compensation on the display data according to the plurality of second optical compensation values and then outputs the optical compensated display data to the first panel.

In an embodiment, the data processing module determines the first overall compensation operation reference by summing absolute values of the plurality of first optical compensation values.

In an embodiment, the data processing module determines the first overall compensation operation reference by summing a product of absolute values of the plurality of first optical compensation values and a parameter.

In an embodiment, when a part of the first optical compensation values has absolute values meeting a specific condition, the data processing module determines the first overall compensation operation reference by summing the absolute values of the part of the first optical compensation values.

In an embodiment, when a part of the first optical compensation values has absolute values and a product of the absolute values and a parameter meets a specific condition, the data processing module determines the first overall compensation operation reference by summing the product of the absolute values of the part of the first optical compensation values and the parameter.

Another preferred embodiment of the invention is an optical compensation apparatus operating method. In this embodiment, the optical compensation apparatus operating method is used for operating an optical compensation apparatus applied to a plurality of panels, a first panel of the plurality of panels including a plurality of sub-pixels for displaying a display data. The optical compensation apparatus operating method includes steps of: (a) measuring a plurality of first optical measurement values corresponding to the plurality of sub-pixels of the first panel; (b) determining a plurality of first optical compensation values needed for the plurality of sub-pixels according to the plurality of first optical measurement values respectively; (c) determining a first overall compensation operation reference of the first panel according to the plurality of first optical compensation values; (d) determining a first demura algorithm suitable for the first panel according to at least one adjustable threshold compensation value and the first overall compensation operation reference; and (e) obtaining a plurality of second optical compensation values according to the first demura algorithm to perform optical compensation on the display data provided to the first panel.

Compared to the prior art, even if the severity of mura varies greatly in different panels, the optical compensation apparatus and the operating method thereof according to the invention can grade the severity of mura exists on all panels at first to obtain the overall compensation operation reference of each panel and use suitable demura algorithm to perform corresponding optical compensation on different panels accordingly; therefore, the over-compensation or under-compensation in the prior art can be avoided to effectively reduce the mura on all panels and achieve the optimized demura effect, and the display quality of the panel can be enhanced to improve the visual enjoyment when users watch the panel.

The advantage and spirit of the invention may be understood by the following detailed descriptions together with the appended drawings.

BRIEF DESCRIPTION OF THE APPENDED DRAWINGS

DETAILED DESCRIPTION OF THE INVENTION

A preferred embodiment of the invention is an optical compensation apparatus. In this embodiment, the optical compensation apparatus is applied to a plurality of panels (e.g., a plurality of OLED panels), but not limited to this. Each of the panels includes a plurality of sub-pixels for displaying a display data.

Figure 1:
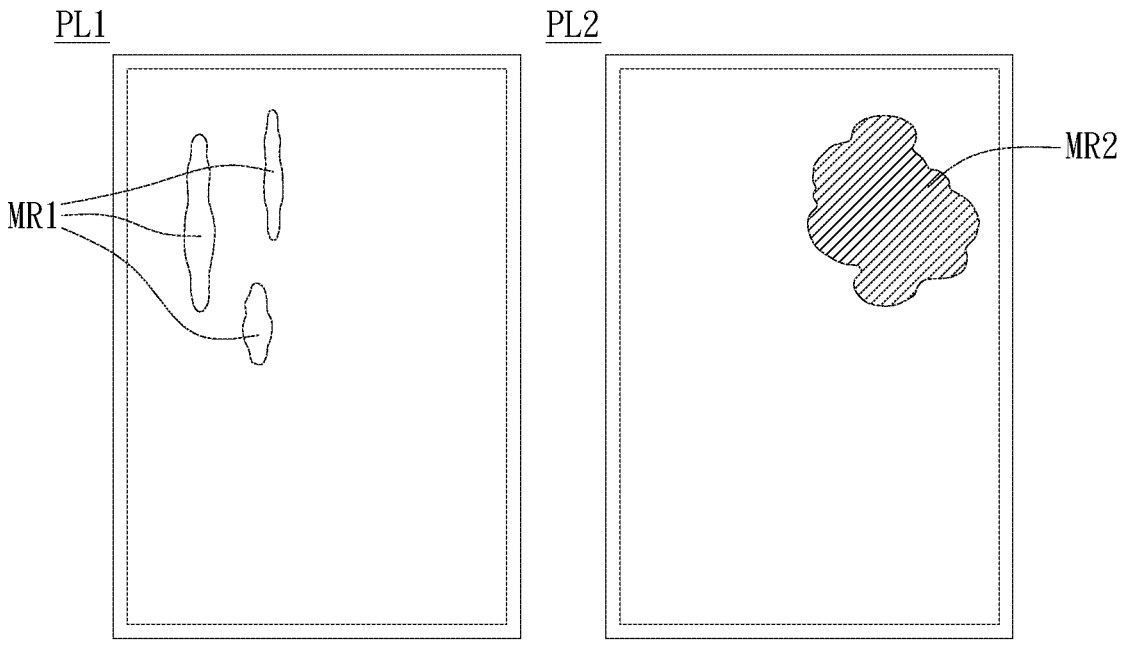
FIG. 1(PRIOR ART)
FIG. 1 illustrates a schematic diagram of the first mura and the second mura having different seventies appeared on the first panel and the second panel respectively.
Figure 2:
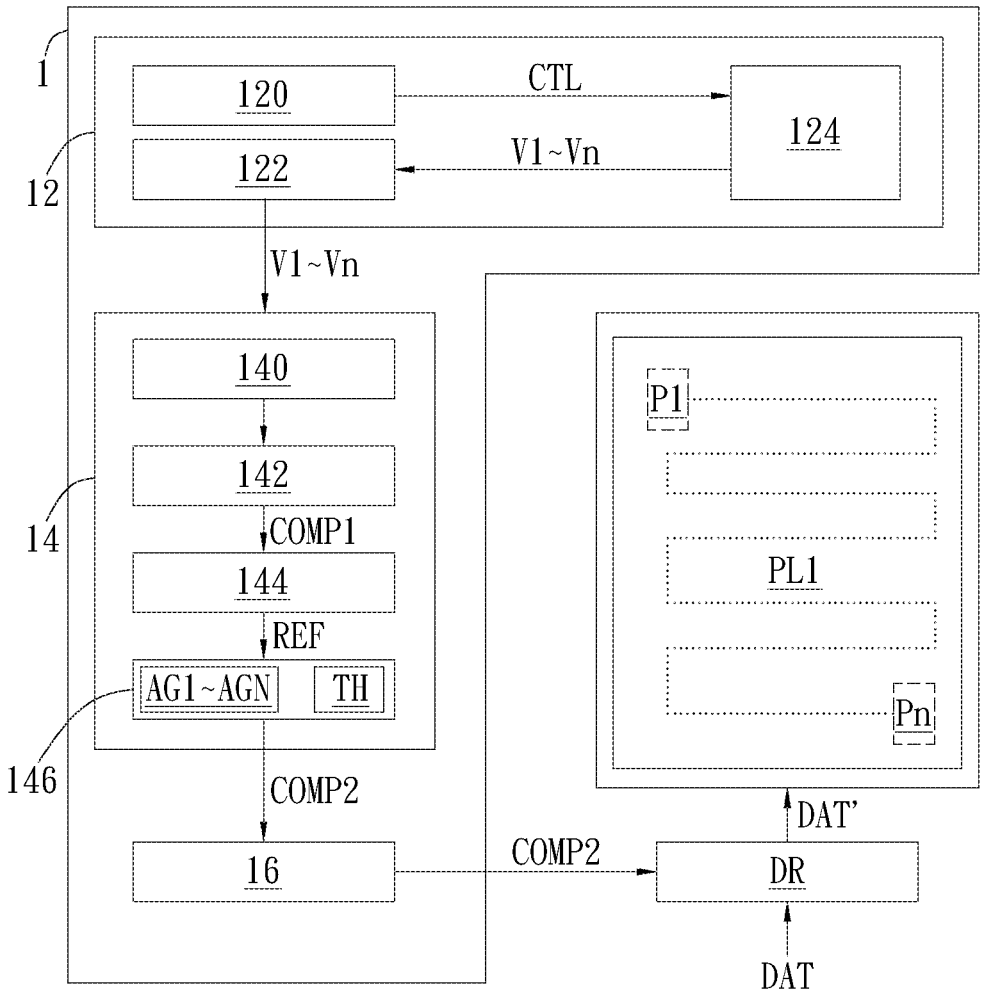
FIG. 2 illustrates a schematic diagram of an optical compensation apparatus applied to the first panel in a preferred embodiment of the invention.

Please refer to FIG. 2. FIG. 2 illustrates a schematic diagram of an optical compensation apparatus 1 applied to a first panel PL1 of the plurality of panels in this embodiment. As for the case where the optical compensation apparatus 1 is applied to other display panels of the plurality of panels, it can be similarly applied.

As shown in FIG. 2, the optical compensation apparatus 1 is disposed corresponding to the first panel PL1, and the optical compensation apparatus 1 and the first panel PL1 are both coupled to a display driving apparatus DR. The display driving apparatus DR is used for receiving a display data DAT and outputting the display data DAT to the sub-pixels P1~Pn of the first panel PL1 for displaying, wherein n is a positive integer larger than 1.

The optical compensation apparatus 1 includes an optical measurement module 12, a data processing module 14 and an optical compensation module 16. The data processing module 14 is coupled to the optical measurement module 12; the optical compensation module 16 is coupled to the data processing module 14 and the optical compensation module 16 is also coupled to the display driving apparatus DR.

The optical measurement module 12 is disposed corresponding to the first panel PL1 and used for measuring a plurality of first optical measurement values V1~Vn (e.g., the lightness, but not limited to this) corresponding to the plurality of sub-pixels P1~Pn of the first panel PL1 respectively.

In this embodiment, the optical measurement module 12 can include a control unit 120, a data accessing unit 122 and an optical sensing unit 124. The control unit 120 and the data accessing unit 122 are both coupled to the optical sensing unit 124.

When the control unit 120 provides a control signal CTL to the optical sensing unit 124, the optical sensing unit 124 will perform optical sensing on the plurality of sub-pixels P1~Pn of the first panel PL1 according to the control signal CTL to obtain the plurality of first optical measurement values V1~Vn corresponding to the plurality of sub-pixels P1~Pn.

Then, the data accessing unit 122 will access the plurality of first optical measurement values V1~Vn from the optical measuring unit 124 and transmit the plurality of first optical measurement values V1~Vn to the data processing module 14. In practical applications, the optical measuring unit 124 can be optical lens or any other device having the optical measuring function, but not limited to this.

In this embodiment, the data processing module 14 can include a data analyzing unit 140, a data processing unit 142, an overall compensation operation reference generation unit 144 and a demura algorithm selection unit 146.

The data analyzing unit 140 is coupled to the optical measurement module 142 and used for receiving and analyzing the plurality of first optical measurement values V1~Vn. The data processing unit 142 is coupled to the data analyzing unit 140 and used for determining the first optical compensation values COMP1 needed for the sub-pixels P1~Pn according to the first optical measurement values V1~Vn respectively.

The overall compensation operation reference generation unit 144 is coupled to the data processing unit 142 and used for determining the first overall compensation operation reference REF of the first panel PL1 according to the plurality of first optical compensation values COMP1.

In practical applications, the overall compensation operation reference generation unit 144 of the data processing module 14 can use different methods to determine the first overall compensation operation reference REF of the first panel PL1 according to the plurality of first optical compensation values COMP1 based on practical needs.

For example, the overall compensation operation reference generation unit 144 can generate the first overall compensation operation reference REF by summing absolute values of the first optical compensation values COMM; the overall compensation operation reference generation unit 144 can generate the first overall compensation operation reference REF by summing a product of absolute values of the first optical compensation values COMP1 and a parameter; when a part of the first optical compensation values COMP1 has absolute values meeting a specific condition (e.g., larger than a specific value, but not limited to this), the overall compensation operation reference generation unit 144 can generate the first overall compensation operation reference REF by summing the absolute values of the part of the first optical compensation values COMP1; when a part of the first optical compensation values COMP1 has absolute values and a product of the absolute values of the part of the first optical compensation values COMP1 and a parameter meets a specific condition (e.g., larger than a specific value, but not limited to this), the overall compensation operation reference generation unit 144 can generate the first overall compensation operation reference REF by summing the product of the absolute values of the part of the first optical compensation values COMP1 and the parameter, but not limited to this.

Figure 3:
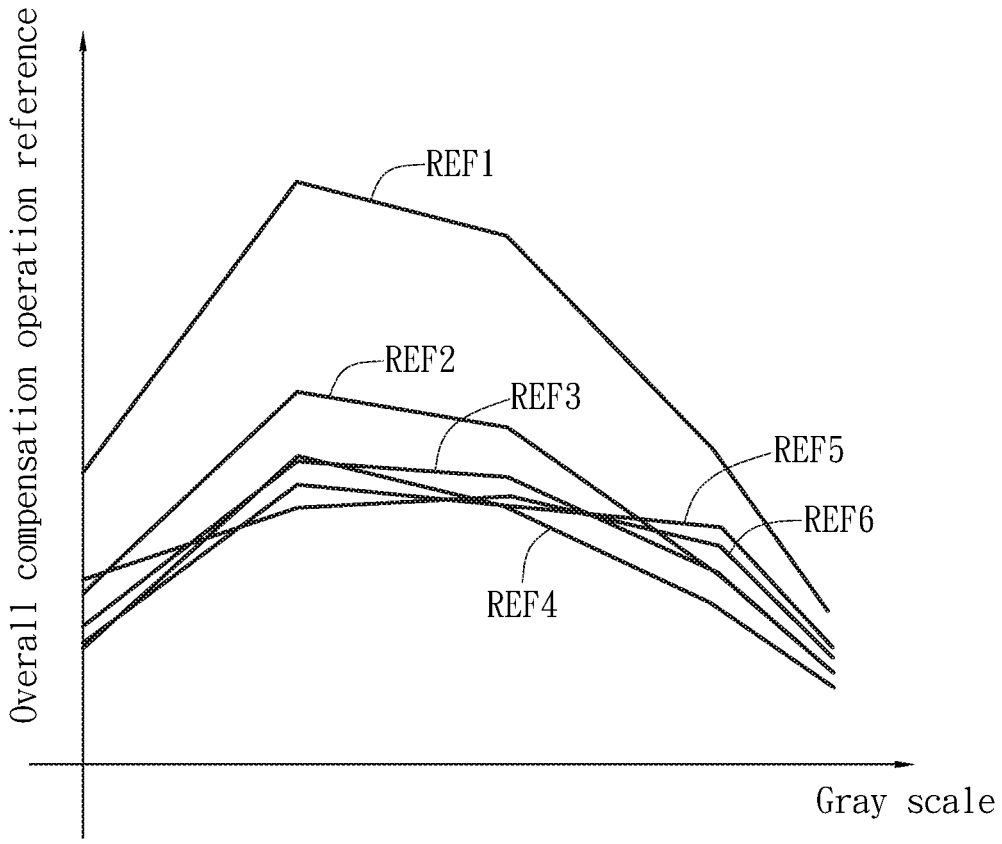
FIG. 3 illustrates an embodiment of the different panels having different overall compensation operation reference curves varied with gray scales respectively.

For example, as shown in FIG. 3, it is assumed that the optical compensation apparatus 1 is applied to six panels and the overall compensation operation reference curves REF1~REF6 of the six panels are varied with gray scales respectively. Since the overall compensation operation reference of each panel can correspond to the severity of the mura on each panel, it can be found that the overall compensation operation reference curve REF1 is obviously higher than other overall compensation operation reference curves REF2~REF6 no matter under what gray scale in FIG. 3. It means that the severity of the mura on the first panel PL1 corresponding to the overall compensation operation reference curve REF1 is obviously higher than the severity of the mura on the other panels corresponding to the other overall compensation operation reference curves REF2~REF6.

The demura algorithm selection unit 146 is coupled to the overall compensation operation reference generation unit 144 and used for determining a first demura algorithm AG1 suitable for the first panel PL1 according to at least one adjustable threshold compensation value TH and the first overall compensation operation reference REF, obtaining a plurality of second optical compensation values COMP2 according to the first demura algorithm AG1 and then outputting the plurality of second optical compensation values COMP2 to the optical compensation module 16.

From the above-mentioned example, since the severity of the mura on the first panel PL1 is obviously higher than the severity of the mura on the other panels, the demura algorithm selection unit 146 will correspondingly select the first demura algorithm AG1 suitable for the serious mura for the first panel PL1 to effectively reduce the serious mura on the first panel PL1. As for the selection of the demura algorithm of the other display panels, it can be similarly described here without further description.

Then, the optical compensation module 16 will output the second optical compensation values COMP2 to the display driving apparatus DR, and the display driving apparatus DR will perform optical compensation on the display data DAT according to the second optical compensation values COMP2 to generate an optically compensated display data DAT'. And then, the display driving apparatus DR will output the optically compensated display data DAT' to the first panel PL1 for displaying.

In practical applications, the demura algorithm selection unit 146 can store the at least one adjustable threshold compensation value TH and N demura algorithms AG1~AGN, and there can be a specific relationship between the at least one adjustable threshold compensation value TH and the N demura algorithms AG1~AGN, wherein N is a positive integer larger than 1.

It should be noticed that the N demura algorithms AG1~AGN can include different mura detections, different calculation formulas, different compression methods and different parameters, etc, but not limited to this.

For example, when the first overall compensation operation reference REF is smaller than or equal to a first threshold compensation value of the at least one threshold compensation value TH, the demura algorithm selection unit 146 of the data processing module 14 will select the first demura algorithm AG1 corresponding to the first threshold compensation value from the N demura algorithms AG1~AGN to be the demura algorithm suitable for the first panel PL1, and so on, but not limited to this.

Another preferred embodiment of the invention is an optical compensation apparatus operating method. In this embodiment, the optical compensation apparatus operating method is used for operating an optical compensation apparatus applied to a plurality of panels and each panel of the plurality of panels includes a plurality of sub-pixels for displaying a display data. And, the severities of mura are different on different panels.

Figure 4:
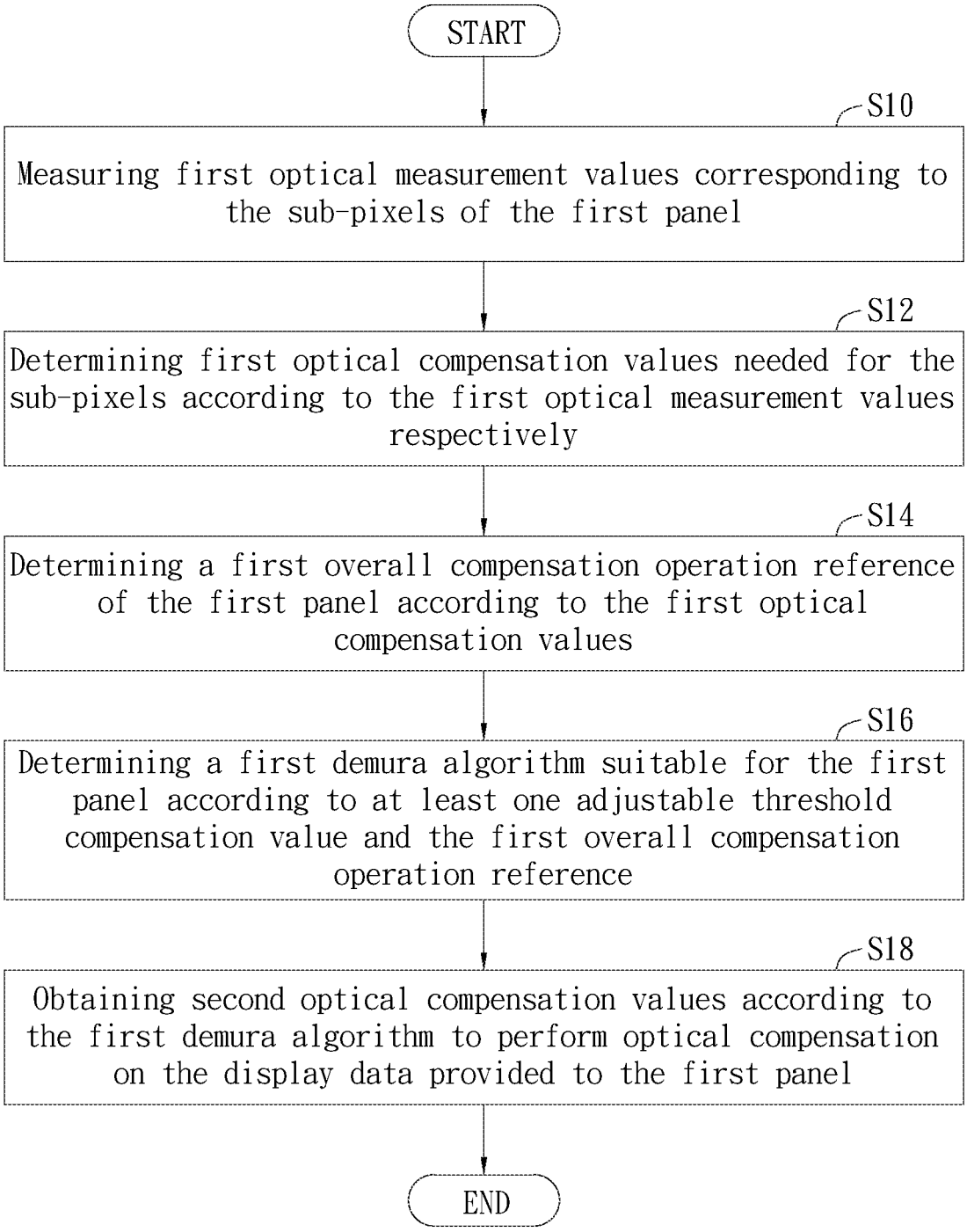
FIG. 4 illustrates a flowchart of an optical compensation apparatus operating method in another embodiment of the invention.

Please refer to FIG. 4. FIG. 4 illustrates a flowchart of the optical compensation apparatus operating method in this embodiment. As shown in FIG. 4, taking a first panel of the plurality of panels for example, the optical compensation apparatus operating method includes following steps.

Step S10: Measuring first optical measurement values corresponding to the sub-pixels of the first panel (e.g., the lightness values of the sub-pixels, but not limited to this).

Step S12: Determining first optical compensation values needed for the sub-pixels according to the first optical measurement values respectively.

Step S14: Determining a first overall compensation operation reference of the first panel according to the first optical compensation values.

Step S16: Determining a first demura algorithm suitable for the first panel according to at least one adjustable threshold compensation value and the first overall compensation operation reference.

Step S18: Obtaining second optical compensation values according to the first demura algorithm to perform optical compensation on the display data provided to the first panel.

Similarly, the above steps can be also applied to each of the other display panels (e.g., the second display panel, the third display panel, etc.) and not be repeated herein. Therefore, the optical compensation apparatus operation method in this embodiment can determine the overall compensation operation reference value of each panel respectively and then determine the appropriate demura algorithm for each panel accordingly to perform different optical compensations on the display data provided to each panel, so that each panel can achieve the optimized demura effect without any occurrence of over-compensation or under-compensation.

Compared to the prior art, even if the severity of mura varies greatly in different panels, the optical compensation apparatus and the operating method thereof according to the invention can grade the severity of mura exists on all panels at first to obtain the overall compensation operation reference of each panel and use suitable demura algorithm to perform corresponding optical compensation on different panels accordingly; therefore, the over-compensation or under-compensation in the prior art can be avoided to effectively reduce the mura on all panels and achieve the optimized demura effect, and the display quality of the panel can be enhanced to improve the visual enjoyment when users watch the panel.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An optical compensation apparatus, applied to a plurality of panels, a first panel of the plurality of panels comprising a plurality of sub-pixels for displaying a display data, the optical compensation apparatus comprising:

an optical measurement module, for measuring a plurality of first optical measurement values corresponding to the plurality of sub-pixels of the first panel;

a data processing module, coupled to the optical measurement module, for determining a plurality of first optical compensation values needed for the plurality of sub-pixels according to the plurality of first optical measurement values respectively, determining a first overall compensation operation reference of the first panel according to the plurality of first optical compensation values, determining a first demura algorithm suitable for the first panel according to at least one adjustable threshold compensation value and the first overall compensation operation reference and obtaining a plurality of second optical compensation values according to the first demura algorithm; and an optical compensation module, coupled to the data processing module, for outputting the plurality of second optical compensation values to perform optical compensation on the display data provided to the first panel;

wherein the data processing module comprises an overall compensation operation reference generation unit configured to determine the first overall compensation operation reference by summing absolute values of the plurality of first optical compensation values.

2. The optical compensation apparatus of claim 1, wherein the plurality of panels is an organic light-emitting diode (OLED) panel.

3. The optical compensation apparatus of claim 1, wherein the plurality of optical measurement values is lightness values of the plurality of sub-pixels.

4. The optical compensation apparatus of claim 1, wherein the optical measurement module comprises:

a control unit, for providing a control signal;

an optical sensing unit, coupled to the control unit, for performing optical sensing on the plurality of sub-pixels of the first panel according to the control signal to obtain the plurality of optical measurement values; and a data accessing unit, coupled to the optical sensing unit, for accessing the plurality of optical measurement values from the optical measuring unit.

5. The optical compensation apparatus of claim 1, wherein the data processing module comprises:

a data analyzing unit, coupled to the optical measurement module, for receiving and analyzing the plurality of optical measurement values;

a data processing unit, coupled to the data analyzing unit, for determining the plurality of first optical compensation values needed for the plurality of sub-pixels according to the plurality of optical measurement values respectively;

the overall compensation operation reference generation unit, coupled to the data processing unit, for determining the first overall compensation operation reference of the first panel according to the plurality of first optical compensation values; and a demura algorithm selection unit, coupled to the overall compensation operation reference generation unit, for determining a first demura algorithm suitable for the first panel according to at least one adjustable threshold compensation value and the first overall compensation operation reference and obtaining the plurality of second optical compensation values according to the first demura algorithm.

6. The optical compensation apparatus of claim 1, wherein when the first overall compensation operation reference is smaller than or equal to a first threshold compensation value of the at least one threshold compensation value, the data processing module determines that the first demura algorithm corresponding to the first threshold compensation value is suitable for the first panel.

7. The optical compensation apparatus of claim 1, wherein the optical compensation module and the first panel are both coupled to a display driving apparatus, and the display driving apparatus receives the display data and the plurality of second optical compensation values respectively and performs optical compensation on the display data according to the plurality of second optical compensation values and then outputs the optical compensated display data to the first panel.

8. An optical compensation apparatus, applied to a plurality of panels, a first panel of the plurality of panels comprising a plurality of sub-pixels for displaying a display data, the optical compensation apparatus comprising:

an optical measurement module, for measuring a plurality of first optical measurement values corresponding to the plurality of sub-pixels of the first panel;

a data processing module, coupled to the optical measurement module, for determining a plurality of first optical compensation values needed for the plurality of sub-pixels according to the plurality of first optical measurement values respectively, determining a first overall compensation operation reference of the first panel according to the plurality of first optical compensation values, determining a first demura algorithm suitable for the first panel according to at least one adjustable threshold compensation value and the first overall compensation operation reference and obtaining a plurality of second optical compensation values according to the first demura algorithm; and an optical compensation module, coupled to the data processing module, for outputting the plurality of second optical compensation values to perform optical compensation on the display data provided to the first panel;

wherein the data processing module comprises an overall compensation operation reference generation unit configured to determines the first overall compensation operation reference by summing a product of absolute values of the plurality of first optical compensation values and a parameter.

9. An optical compensation apparatus, applied to a plurality of panels, a first panel of the plurality of panels comprising a plurality of sub-pixels for displaying a display data, the optical compensation apparatus comprising:

an optical measurement module, for measuring a plurality of first optical measurement values corresponding to the plurality of sub-pixels of the first panel;

a data processing module, coupled to the optical measurement module, for determining a plurality of first optical compensation values needed for the plurality of sub-pixels according to the plurality of first optical measurement values respectively, determining a first overall compensation operation reference of the first panel according to the plurality of first optical compensation values, determining a first demura algorithm suitable for the first panel according to at least one adjustable threshold compensation value and the first overall compensation operation reference and obtaining a plurality of second optical compensation values according to the first demura algorithm; and an optical compensation module, coupled to the data processing module, for outputting the plurality of second optical compensation values to perform optical compensation on the display data provided to the first panel;

wherein when a part of the first optical compensation values has absolute values meeting a specific condition, the data processing module comprises an overall compensation operation reference generation unit configured to determines the first overall compensation operation reference by summing the absolute values of the part of the first optical compensation values.

* * * * *